US007770502B2

(12) United States Patent
Parrish et al.

(10) Patent No.: US 7,770,502 B2
(45) Date of Patent: Aug. 10, 2010

(54) LASER-GUIDED PAPER TRIMMER

(75) Inventors: Michael Parrish, Westerville, OH (US); Thomas Wiberg, Statesville, NC (US); Robert Anderson, Mooresville, NC (US); John Gardiner, Statesville, NC (US)

(73) Assignee: Elmer's Products Inc, Columbus, OH (US)

( * ) Notice: Subject to any disclaimer, the term of this patent is extended or adjusted under 35 U.S.C. 154(b) by 191 days.

(21) Appl. No.: 12/112,224

(22) Filed: Apr. 30, 2008
(Under 37 CFR 1.47)

(65) Prior Publication Data

US 2009/0173202 A1 Jul. 9, 2009

Related U.S. Application Data

(63) Continuation-in-part of application No. 11/002,572, filed on Dec. 2, 2004, now abandoned.

(60) Provisional application No. 60/526,695, filed on Dec. 2, 2003.

(51) Int. Cl.
*B26D 7/00* (2006.01)

(52) U.S. Cl. ..... 83/522.15; 83/520; 83/607; 200/335

(58) Field of Classification Search ..... 83/520, 83/522.11–522.15, 607, 608, 609; 200/332, 200/335
See application file for complete search history.

(56) References Cited

U.S. PATENT DOCUMENTS 2,378,249 A 6/1945 Ruth
2,444,723 A 7/1948 Bowen
3,410,994 A * 11/1968 Facto ..... 362/89
4,759,747 A 7/1988 Aida et al.
4,769,747 A * 9/1988 Parrillo ..... 362/89
4,885,967 A 12/1989 Bell et al.
5,285,708 A 2/1994 Bosten et al.
5,320,011 A * 6/1994 Lee ..... 83/13
5,446,635 A 8/1995 Jehn
5,556,826 A 9/1996 Perrington et al.
5,862,727 A 1/1999 Kelly
5,918,523 A 7/1999 Cutter
5,931,513 A 8/1999 Conti
6,423,930 B1 7/2002 Matsumoto
6,481,322 B1 11/2002 Hsiung
6,644,156 B2 11/2003 Villacis
7,377,202 B1 * 5/2008 Shibata ..... 83/520
2001/0037528 A1 11/2001 Ackeret
2001/0049988 A1 * 12/2001 Ushiwata et al. ..... 83/520
2002/0170404 A1 11/2002 Peot et al.
2003/0019243 A1 1/2003 Biethmann et al.

(Continued)

*Primary Examiner*—Boyer D. Ashley
*Assistant Examiner*—Edward Landrum
(74) *Attorney, Agent, or Firm*—McNees Wallace & Nurick

(57) ABSTRACT

A cutting device for paper or other materials including a substantially flat base, a manually-operated cutting blade assembly, a sighting device, and a switch is provided. The base is adapted to receive substantially thin or flat materials for cutting. The manually-operated cutting blade assembly is pivotally attached to either side of the base and includes an elongated cutting arm positioned over a predetermined line of cut on the base. The sighting device includes a housing and an adjustable light source mounted within and protected by the housing, wherein the light source projects a fixed line of visible light along the predetermined line of cut. The switch and switch actuator activate and deactivate the light source.

19 Claims, 9 Drawing Sheets

U.S. PATENT DOCUMENTS

2003/0047050 A1 3/2003 Onose et al.
2003/0131704 A1 * 7/2003 Villacis ..... 83/520
2003/0140758 A1 7/2003 Weusthof et al.
2003/0196337 A1 10/2003 Wu
2003/0233921 A1 12/2003 Garcia et al.
2004/0049927 A1 3/2004 Wu
2005/0199114 A1 * 9/2005 Tseng ..... 83/522.11

* cited by examiner

LASER-GUIDED PAPER TRIMMER

CROSS-REFERENCE TO RELATED APPLICATIONS

This application is a continuation-in-part of U.S. patent application Ser. No. 11/002,572, filed on Dec. 2, 2004 and entitled "Trimmer with Laser Guide", which claimed the benefit of U.S. Provisional Patent Application Ser. No. 60/526,695, filed on Dec. 2, 2003, the complete disclosures of which are expressly incorporated by reference, as if fully rewritten herein.

BACKGROUND OF THE INVENTION

Many devices for trimming or cutting substantially flat material such as printer paper or photographic paper are commercially available. Generally, these trimmers include a raised portion on the back edge thereof located at a right angle relative to the device's cutting blades for enabling straight, right-angle cuts. The material to be cut is trimmed by placing one edge of the material against the raised portion on the base and the edge to be cut under or between the cutting blades and depressing a cutting arm to engage the cutting blades.

While generally effective for their intended purpose, such devices do not typically includes means for aligning a cut at an irregular angle or visually aligning such a cut. Despite various alignment tools, rulers and the like, the actual line of cut of the cutting blade is at best difficult to determine, making consistent, precise, aligned cuts virtually impossible. For example, with guillotine-type trimmers, while the location of the edge of the lower blade, and ultimately the location of the cut, can be estimated by coordination of the visually observed location of where the edges of the material meet the blade edge, once the material is placed in a cutting position, the material covers the lower blade edge and the actual line of the cut cannot be determined unless the material is transparent. Thus, there is a need for a means by which the operator of a paper trimmer can more effectively align or orient the material to be cut relative to the actual line of cut provided by the cutting blades.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a system for cutting paper or other materials is provided. This system includes a cutting device having a substantially flat base, wherein the base is adapted to receive paper and other flat material for cutting, and wherein the base further includes a front edge, a rear edge, a left side and a right side. A manually-operated cutting blade assembly is pivotally attached to either the right or left side of the base near the rear edge thereof. The cutting blade assembly further includes an elongated cutting arm having a handle grip formed at one end thereof and the elongated cutting arm is positioned over a predetermined line of cut on the base. A sighting device is mounted on the base on the same side as the elongated cutting arm and further includes a housing and an adjustable light source mounted within and protected by the housing. The light source projects a fixed line of visible light along the predetermined line of cut for facilitating proper placement of the paper or other material on the base prior to and during cutting. A switch is included for activating and deactivating the light source, wherein a first portion of the switch is located in the handle grip and wherein a second portion of the switch is located within the housing. The light source is activated when the elongated cutting arm is raised and is deactivated when the elongated cutting arm is lowered. As previously indicated, the material that may be cut using this system includes paper, cardboard, plastic, and other similarly thin and flexible materials.

In accordance with another aspect of the present invention, a cutting device is provided. This device includes a substantially flat base, wherein the base is adapted to receive paper and other flat material for cutting, and wherein the base further includes a front edge, a rear edge, a left side and a right side. The base may include a grid, ruler, and other means for aligning materials thereon. A manually-operated cutting blade assembly is pivotally attached to either the right or left side of the base near the rear edge thereof. The cutting blade assembly further includes an elongated cutting arm having a handle grip formed at one end thereof and the elongated cutting arm is positioned over a predetermined line of cut on the base. A sighting device is mounted on the base on the same side as the elongated cutting arm and further includes a housing and an adjustable light source mounted within and protected by the housing. The light source projects a fixed line of visible light from the front edge of the base toward the rear edge of the base along the predetermined line of cut for facilitating proper placement of the paper or other material on the base prior to and during cutting. A switch is included for activating and deactivating the light source, wherein a first portion of the switch is located in the handle grip and wherein a second portion of the switch is located within the housing. The light source is activated when the elongated cutting arm is raised and is deactivated when the elongated cutting arm is lowered.

In accordance with yet another aspect of this invention, a paper cutting and trimming device is provided. This device includes a substantially flat base, wherein the base is adapted to receive paper and other flat material for cutting, and wherein the base further includes a front edge, a rear edge, a left side and a right side. The base may include a grid, ruler, and/or other means for aligning materials thereon. A manually-operated cutting blade assembly is pivotally attached to either the right or left side of the base near the rear edge thereof. The cutting blade assembly further includes an elongated cutting arm having a handle grip formed at one end thereof and the elongated cutting arm is positioned over a predetermined line of cut on the base. A sighting device is mounted on the base on the same side as the elongated cutting arm and further includes a housing and an adjustable laser light source mounted within and protected by the housing. The laser light source projects a fixed line of visible (i.e, red) light from the front edge of the base toward the rear edge of the base along the predetermined line of cut for facilitating proper placement of the paper or other material on the base prior to and during cutting. A multi-part switch is included for activating and deactivating the light source, wherein a first portion of the switch is located in the handle grip and wherein a second portion of the switch is located within the housing. The light source is activated when the elongated cutting arm is raised and is deactivated when the elongated cutting arm is lowered. This embodiment of the present invention also includes a battery-saving timing mechanism that automatically deactivates the laser after a period of time if the cutting arm has been inadvertently left in the "up" position causing the laser to remain on for longer than intended.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
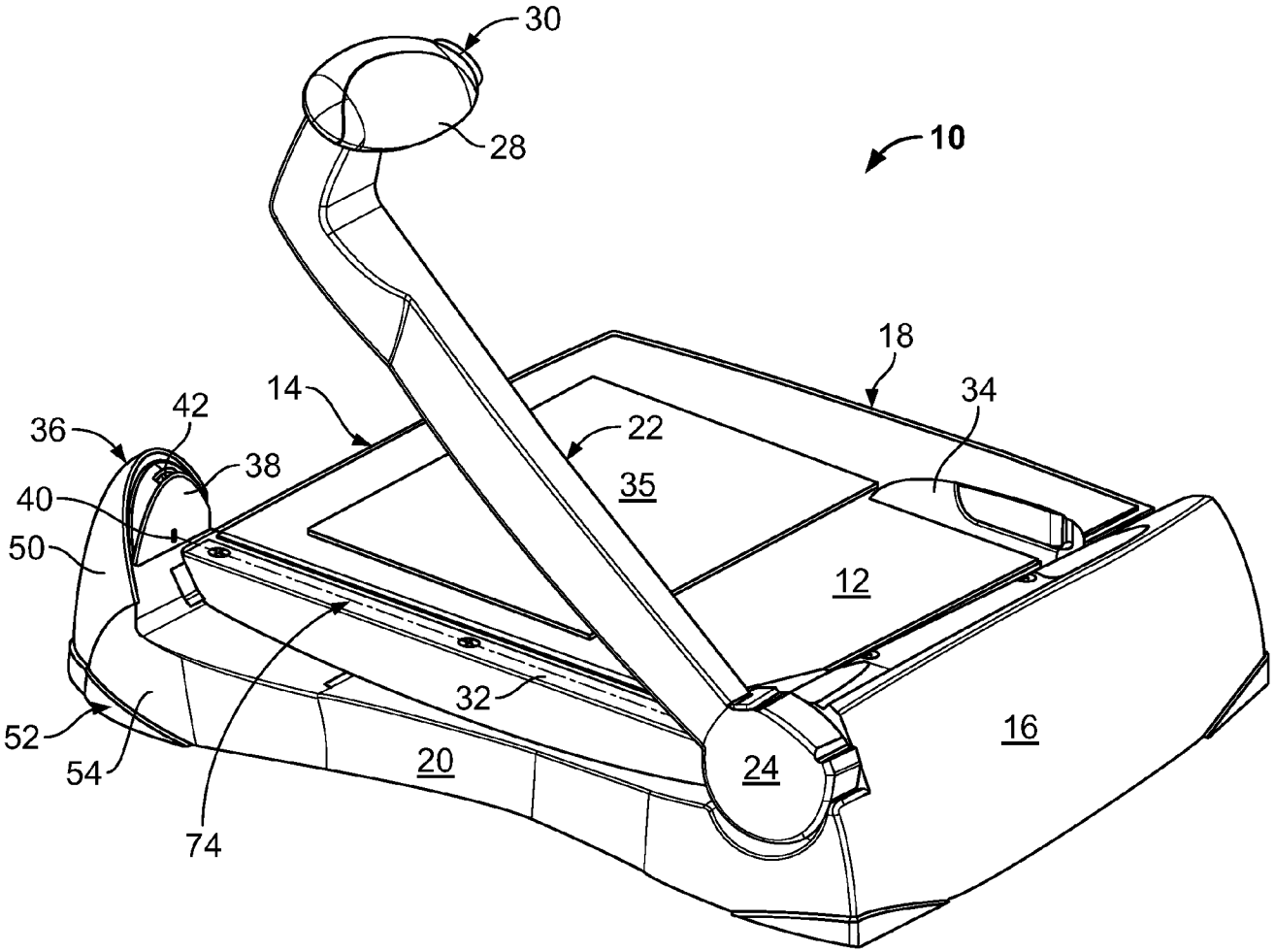
FIG. 1 is rear perspective view of an exemplary embodiment of a paper cutting device according to the present invention.
Figure 2:
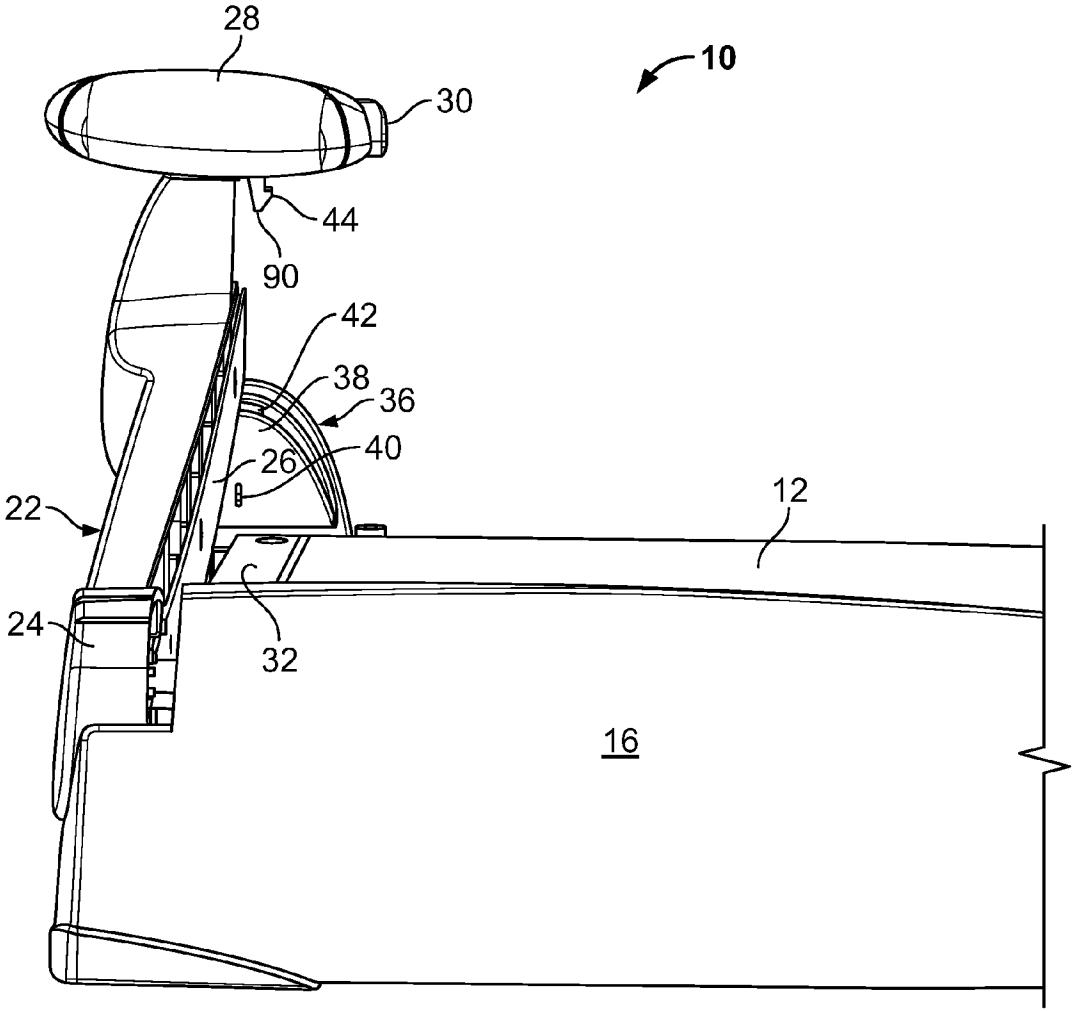
FIG. 2 is a rear view of the paper cutting device of FIG. 1 showing a portion of the cutting blade assembly.
Figure 3:
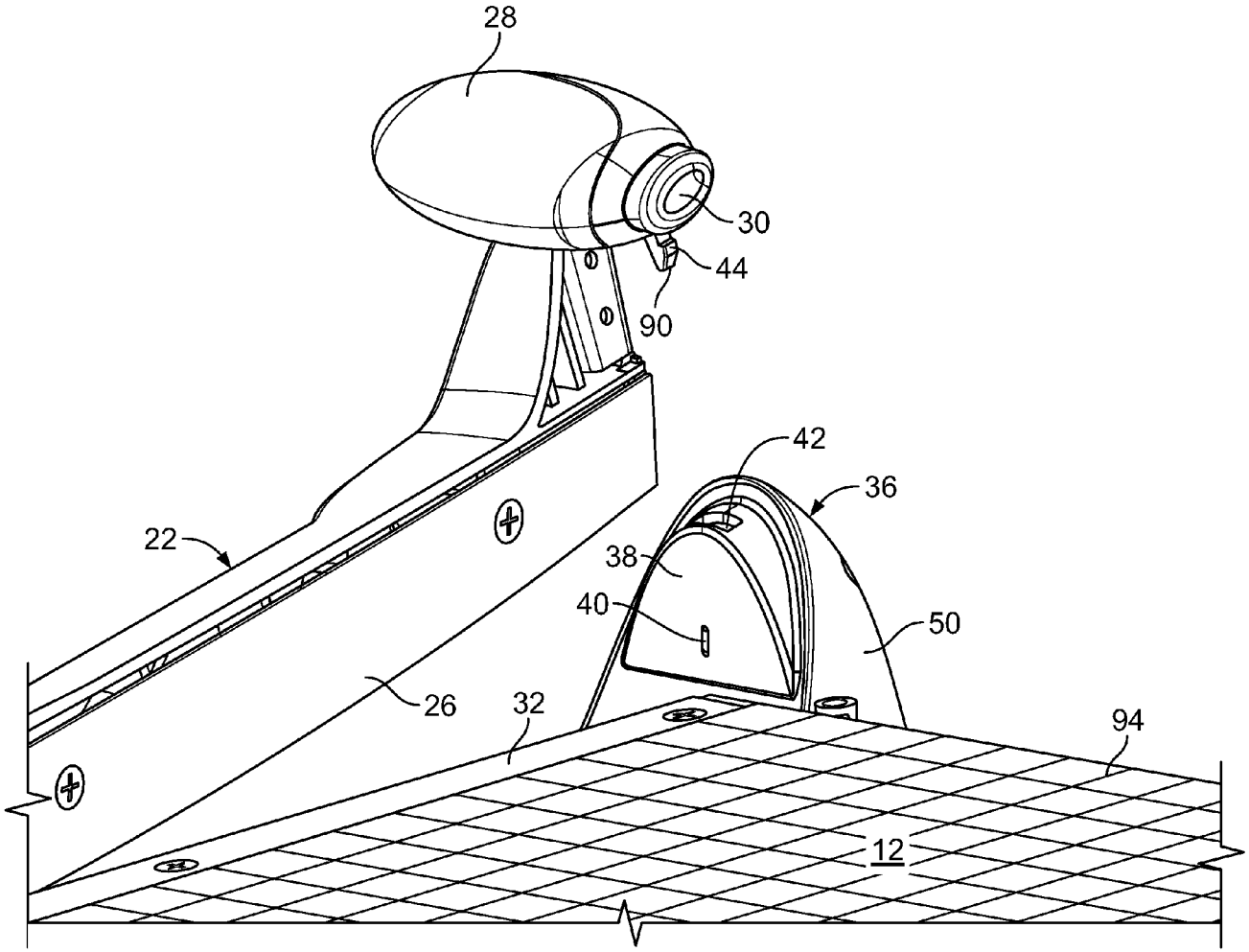
FIG. 3 is a perspective view of the paper cutting device of FIG. 1 showing a portion of the cutting blade assembly in the "up" or open position.

Exemplary embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention. For the purpose of the description herein, the terms "upper," "lower," "right," "left," "rear," "front," "vertical," "horizontal," and derivatives thereof shall relate to the invention as oriented in FIG. 1 with the front 14 of the apparatus being generally at the top-left as shown. However, it is to be understood that the invention may assume various alternative orientations, except where expressly specified to the contrary.

The present invention relates to a guided paper cutting and trimming system and device. As previously indicated, a first general embodiment provides a system for cutting paper; a second general embodiment provides a light-guided device for paper cutting and trimming; and a third general embodiment of this invention provides a laser-guided device for cutting and trimming paper and other materials. With reference now to the Figures, one or more specific embodiments of this invention shall be described in greater detail.

FIGS. 1-9 provide various illustrative views of certain exemplary embodiments of the present invention and various features thereof. Cutting device 10 is generally illustrated in FIGS. 1-4. As shown in FIG. 1, cutting device 10 includes a substantially flat base 12, a pivotally or translationally moveable cutting arm assembly 22 having a cutting blade 26, sighting device 64, and light source 46. Base 12 is adapted to receive material 35 and for the further purpose of cutting or trimming material 35. Material 35 that may be cut using this system includes paper, cardboard, plastic, and other similarly thin and flexible materials. Base 12 further includes front edge 14, rear edge 16, left side 18, and right side 20 (see FIG. 1). Base 12 may include additional features such as a moveable or removable paper guide 34. Base 12 may also have a grid or other aligning means formed or mounted on its surface and a ruler formed or mounted on rear edge 16 and aligned with the grid for measuring objects to be cut.

Again, with reference to the exemplary embodiment shown in FIGS. 1-4, cutting device 10 is a guillotine-type cutter. A manually-operated cutting blade assembly 22 is pivotally 24 attached to either the right side 20 or the left side 18 of base 12 near rear edge 16. Cutting blade assembly 22 further includes an elongated cutting arm having a cutting blade 26 and a handle grip 28 formed at one end. The elongated cutting arm is positioned over a predetermined line of cut on base 12. This guillotine-type paper cutter further includes a stationary lower blade 32 with which the cutting blade 26 of the cutting arm assembly 22 cooperates when the device is in use.

The exemplary embodiment shown in the Figures further includes a sighting device assembly 64 mounted on base 12 of cutting device 10 on the same side as cutting arm assembly 22. Sighting device assembly 64 includes housing 36 and an adjustable light source 46 mounted within and protected by the housing 36. Light source 46 projects a fixed line of visible light 74 along a predetermined line of cut for facilitating proper placement of the material to be cut on base 12. Switch 78 and switch actuator 90 activate and deactivate light source 46. Switch actuator 90 is located in handle grip 28 of cutting arm assembly 22 and switch 78 is located within housing 36. Switch 78 and switch actuator 90 cooperate with one another to either activate or interrupt an electrical circuit to turn light source 46 on or off. Light source 46 is activated when cutting arm assembly 22 is raised and switch actuator 90 loses contact with switch 78 and light source 46 is deactivated when the cutting arm assembly 22 is lowered and switch actuator 90 contacts switch 78 (see FIGS. 8-9).

Figure 8:
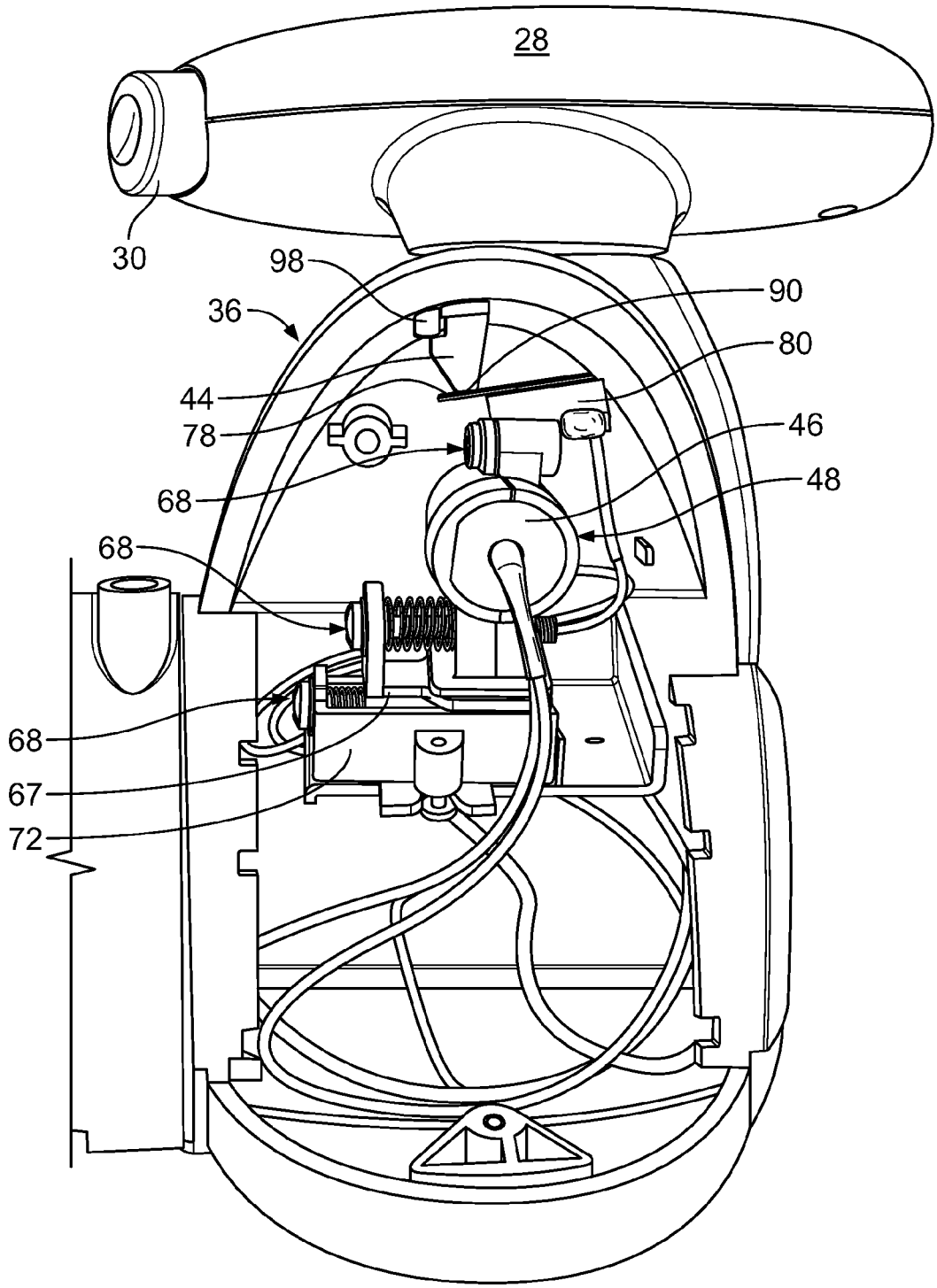
FIG. 8 is a front view of the light source mounting assembly showing the switch in the "off" position.
Figure 9:
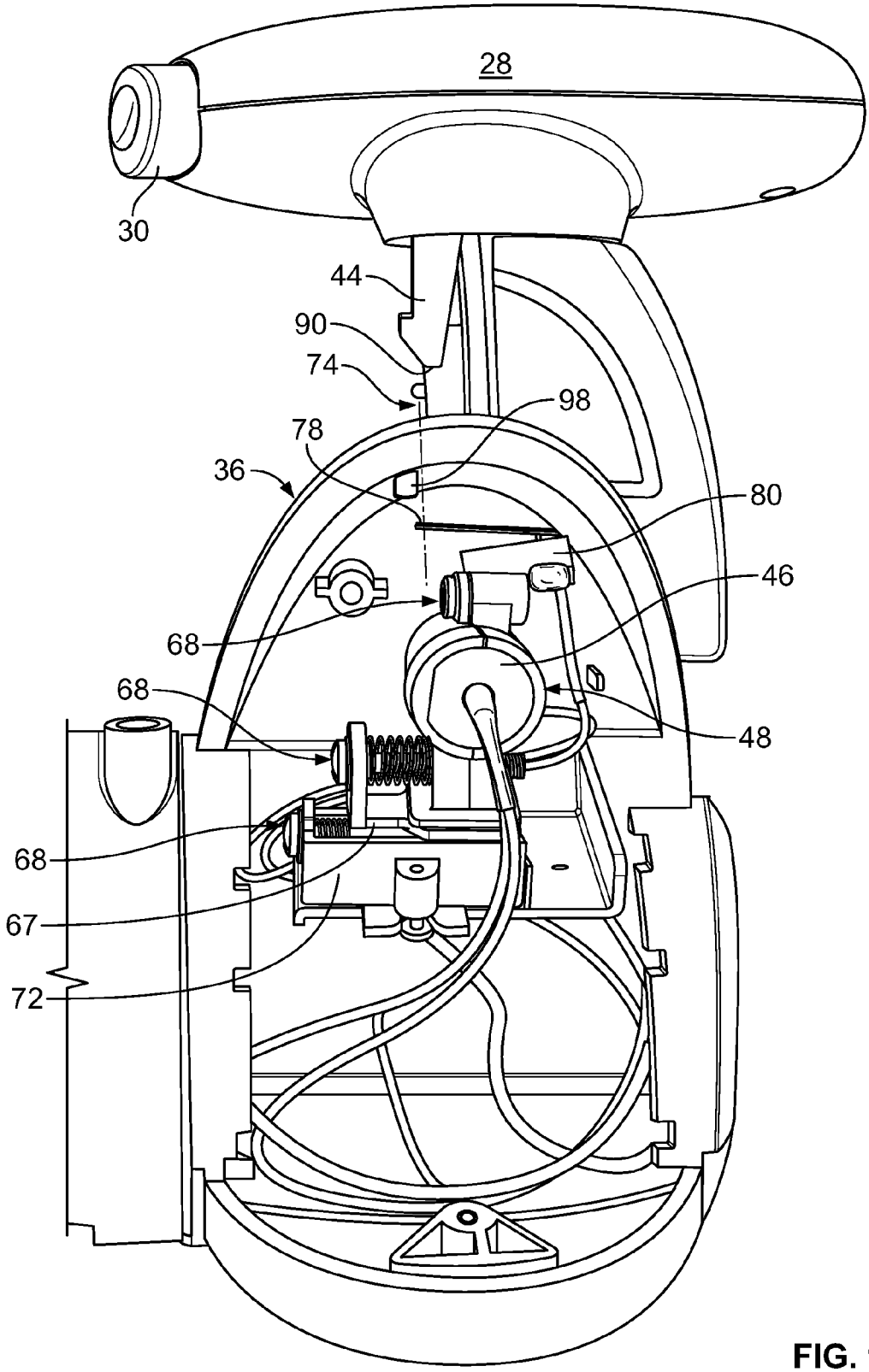
FIG. 9 is a front view of the light source mounting assembly showing the switch in the "on" position.

Handle grip 28 on cutting arm assembly 22 includes button 30, which releases or locks hook 44, thereby creating a manually-releasable locking means. Hook 44 cooperates with aperture or opening 42 in housing assembly 36 to secure cutting arm assembly 22 in a "closed" position. Hook 44 catches a portion of latch 98 of housing assembly 36 and retains cutting arm assembly 22 in a "locked" position until button 30 is depressed. As shown in FIGS. 8-9, switch actuator 90 or end portion of hook 44 activates or deactivates switch 78, which controls the operation of light source 46. Light source 46 is activated when switch actuator 90 of hook 44 is released from latch 98 which allows switch actuator 90 of hook 44 to disengage from or no longer compress switch 78. Hook 44 is released from latch 98 by pushing button 30 located on handle grip 28 of cutting arm assembly 22, which is done when the user desires to raise cutting arm assembly 22 into the open position ready for cutting. Sighting device assembly 64 is deactivated when hook 44 is inserted through opening 42 of housing assembly 36, thereby activating switch 78. Timer 80 (see FIGS. 8 and 9) is included in some embodiments for turning light source 46 off after a predetermined amount of time (e.g., two minutes) has passed, even if switch actuator 90 of hook 44 is not re-inserted into opening 42 to depress switch 78.

Sighting device assembly 64 projects a visible beam of light along a predetermined line of cut and provides a means by which to accurately align and position the material to be cut on base 12. Sighting device 64 may include any type of light source that provides a consistently visible beam of light. In the exemplary embodiments discussed herein, sighting device assembly 64 includes at least one laser, which generates a thin beam of red or orange light. This laser typically provides a wavelength of between about 630 to about 670 nanometers at about 0.1 to about 5 milliwatts of power and is considered safe for use by the average consumer. Other commercially available lasers and light sources are compatible with this invention.

Figure 4:
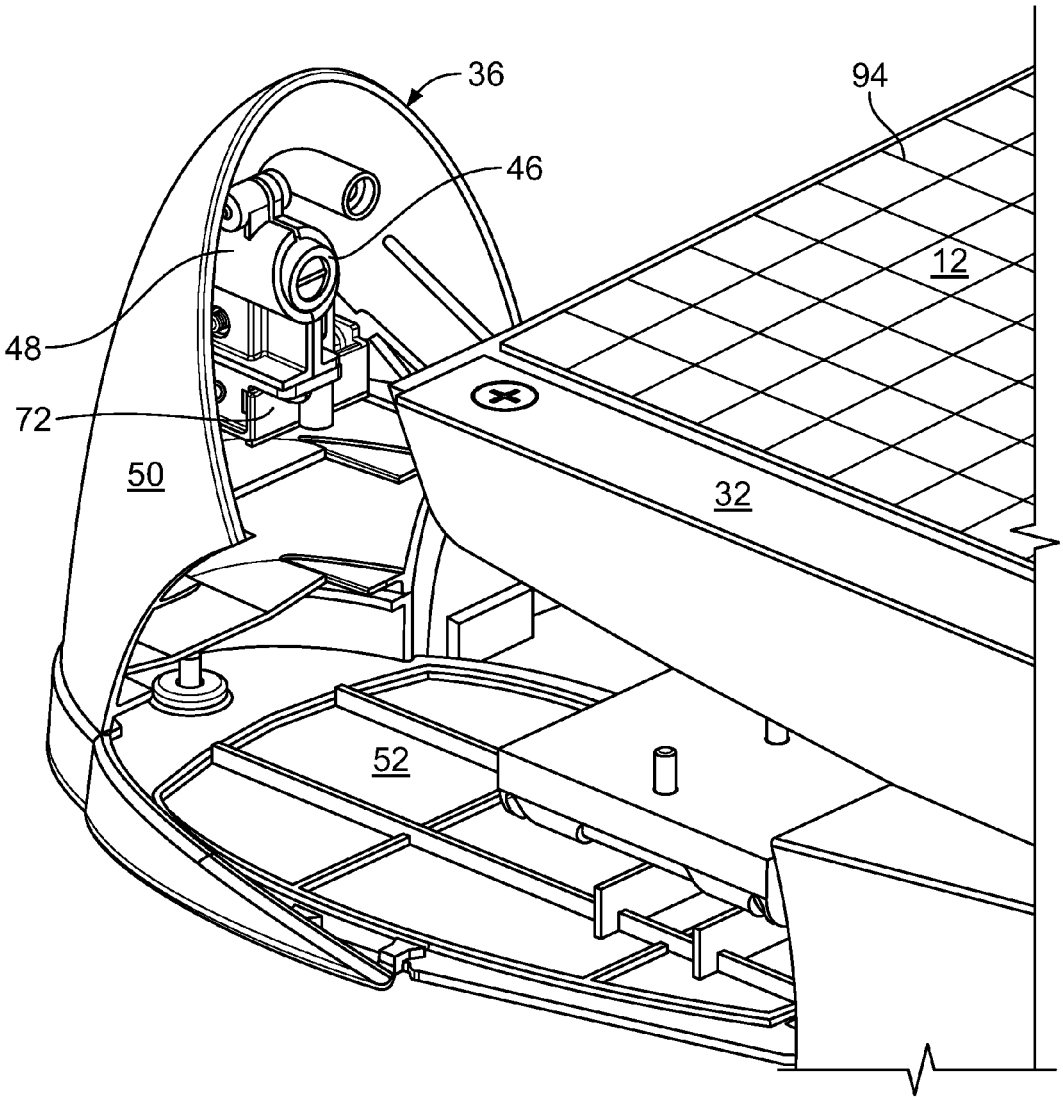
FIG. 4 is a perspective view of an exemplary embodiment of the present invention that includes a laser light source within in housing mounted on the base of the paper cutting device, wherein the cover of the housing has been removed.

As shown in FIGS. 1-4 sighting device assembly 64 is located in base 12. The placement of sighting device assembly 64 in base 12 provides a substantially fixed line of light because sighting device assembly 64 operates independent of the position of moveable cutting blade 26, arm 22, and handle grip 28. In an exemplary embodiment, sighting device assembly 64 is located in a module located at the front edge 14 of base 12 opposite the pivotal attachment point of cutting arm assembly 22. When in use, sighting device assembly 64 operates to project a line of light 74 along the edge of a stationary lower cutting blade 32 rearward toward pivot point 24. As shown in FIGS. 1 and 4, sighting device assembly 64 is mounted within housing portion 36. Housing portion 36 is configured to securely retain sighting device assembly 64 and protect it from accidental and unintended impact. Housing portion 36 includes exit means 40 for allowing the line of light to pass through housing 36. Exit means 40 is typically positioned near the beam emitting end of the sighting device assembly 64, and includes, but is not limited to, at least one orifice or slot provided in housing wall 38, a transparent portion provided housing wall 38 (not shown), or an open portion in housing 36. The orifice, slot, or other opening allows sighting device assembly 64 to project a line of light along a pre-selected line such as a cutting line or margin line (see dashed line 74 in FIG. 1), and this line will be clearly visible to the user on the surface of the material to be cut.

Figure 6:
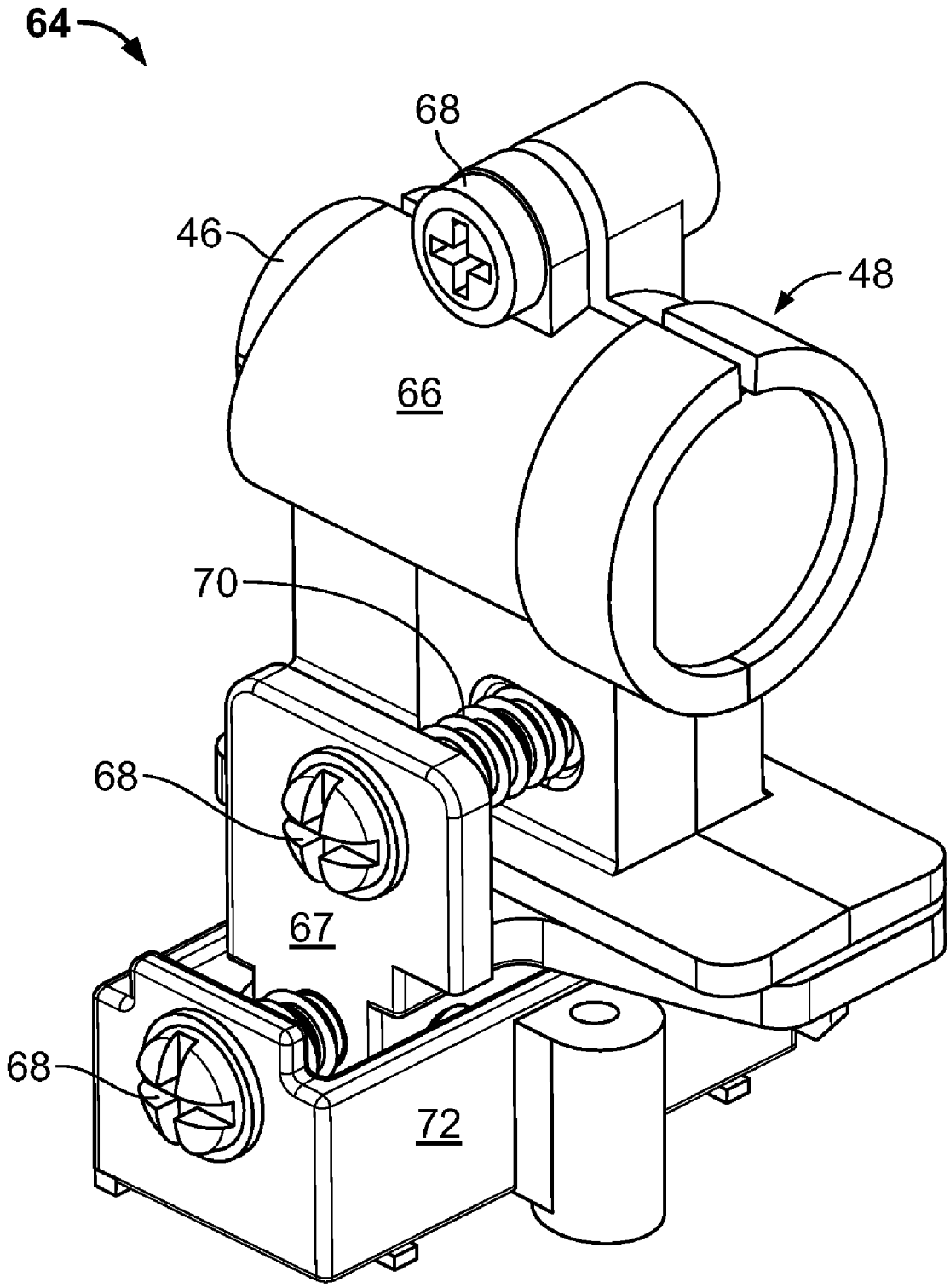
FIG. 6 is a rear perspective view of the light source mounting assembly of the paper cutting device of FIG. 4.
Figure 7:
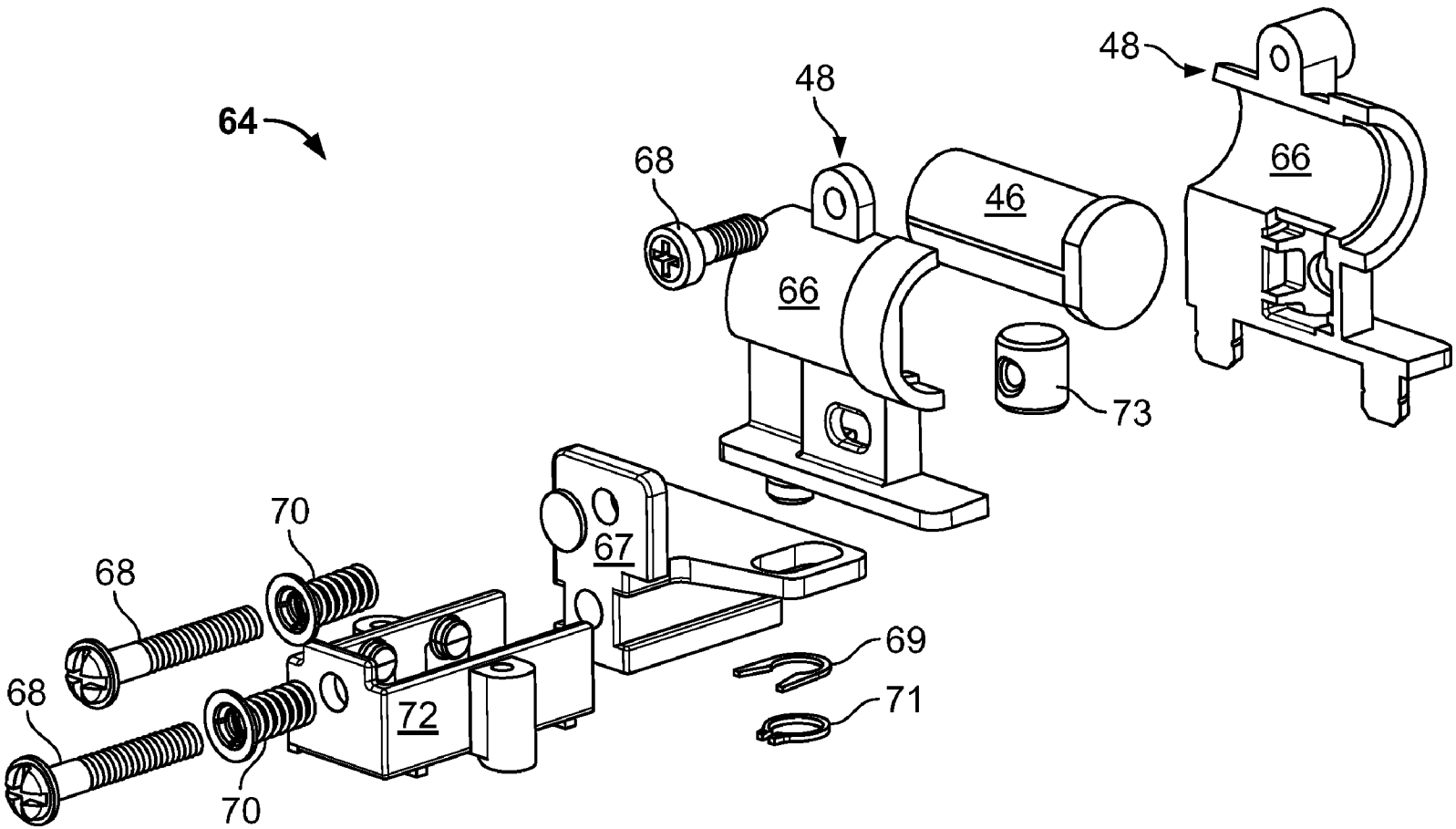
FIG. 7 is an exploded view of the light source mounting assembly of the paper cutting device of FIG. 4.

Sighting device assembly 64 includes means for adjusting the position and orientation of sighting device 64 so as to direct the beam of light along a predetermined path at a desired height and orientation. As shown in FIGS. 4, 6 and 7, these adjusting means include a series of screws 68 that may be loosened for the purpose of re-positioning sighting device assembly 64 within housing 36. As shown in FIGS. 6-7, sighting device assembly 64 further includes a top portion 48 having two concave sides 66. Sighting device assembly 64 is supported by a stabilizing peg 73 that receives screw 68. Concave sides 66 are attached to one another to secure light source 46 therein. Top portion 48 is attached to middle portion 67 by washers 69, 71 and is held in place by the tension thereof. Middle portion 67 is attached to a bottom portion 72 by screws 68 or other attachment means. Screws 68 include biasing members 70, which are axially mounted thereon to maintain tension on concave sides 66. Bottom portion 72 is adjustably mounted to housing assembly 36 by screws (not shown) or other means for tensionally or frictionally securing sighting device assembly 64 in a selected position and orientation.

Figure 5:
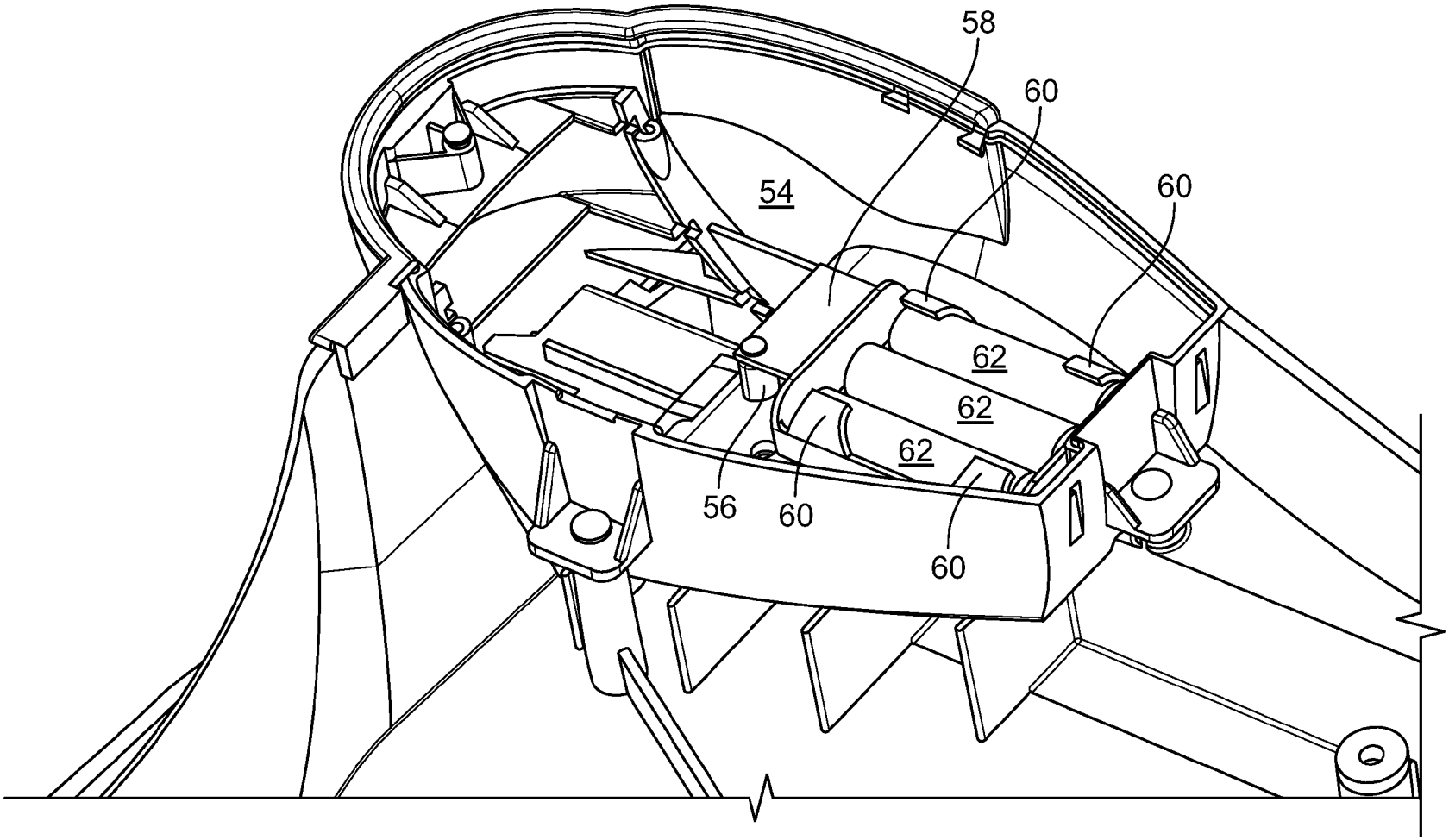
FIG. 5 is a bottom view of the housing portion of the paper cutting device of FIG. 4 showing one possible power source for the light source.

As shown in FIGS. 4 and 5, housing assembly 36 is of sufficient size and volume to permit the sighting device assembly 64 to be housed in close proximity to a power source 56. In the exemplary embodiment shown in the Figures, housing assembly 36 includes a battery mount 60 for receiving and retaining at least one battery 62. Housing assembly 36 may also included circuit board mount 58 for securely receiving and retaining a circuit board (not shown) for controlling the electrical connectivity and features of the timer 80. As shown in FIGS. 1 and 4, housing assembly 36 further includes arcuate front cover 50, side cover 54, and lower cover portion 52. Lower cover potion 52 can be accessed and removed from the bottom of base 12 for allowing a user to replace batteries 62 or for a technician to service sighting device assembly 64 or other internal circuitry.

Timer 80 further includes a circuit board for shutting off the power supply to deactivate light source 46 when cutting arm assembly 22 is maintained in a raised position. In an exemplary embodiment, timer 80 deactivates light source 46 after 60 seconds of inactivity when the cutting blade assembly 22 had not be returned to a "locked" position.

When cutting device 10 is in use, material 35 to be cut is placed on base 12 of cutting device 10. The user lifts cutting arm assembly 22 by pushing the button 30 on handle grip 28 to release hook 44 from latch 98 and slot 42 in housing assembly 36. Once switch actuator 90 of hook 44 disengages switch 78, light source 46 is activated and line of sight 74 is projected along the cutting plane of bottom cutting blade 32. The user may then align the material to be cut using the grid 94 and/or ruler (not shown) on base 12 of cutting device 10. Once material 35 is aligned, the user will be able to clearly see line of sight 74 on material 35 to be cut. The user then applies downward force to actuate cutting arm assembly 22 such that it cooperates with the bottom cutting blade 32, which cuts the material. When the user is finished, cutting arm assembly 22 is returned to the "locked" position shown in FIG. 8. If the user fails to return cutting arm assembly 22 to the "locked" position, timer 80 will automatically turn off light source 46 after a predetermined period of time.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A system for cutting material, comprising:

(a) a cutting device, wherein the cutting device further includes:

(i) a substantially flat base, wherein the base is adapted to receive paper and other flat material for cutting, and wherein the base further includes a front edge, a rear edge, a left side, and a right side;

(ii) a manually-operated cutting blade assembly pivotally attached to either the right or left side of the base near the rear edge thereof, wherein the cutting blade assembly further includes an elongated cutting arm having a handle grip formed at one end thereof, and wherein the elongated cutting arm is positioned over a predetermined line of cut on the base;

(iii) a sighting device mounted on the front edge of the base on the same side as the elongated cutting arm, wherein the sighting device further includes:

a) a protective housing, the protective housing further including a removable arcuate front cover, a side cover, and a removable lower cover; and b) an adjustable light source mounted within and protected by the housing, wherein the adjustable light source further includes:

i) a top portion having two concave sides, wherein the two concave sides secure the light source therein;

ii) a middle portion that receives the top portion, wherein the middle portion further includes a stabilizing peg and plurality of screws and biasing members adapted to allow lateral or horizontal movement of the middle portion and top portion to adjust the light source;

iii) a bottom portion adapted to receive the middle portion, wherein the bottom portion is adjustably mounted to housing assembly; and wherein the adjustable light source projects a fixed line of visible light along the predetermined line of cut for facilitating proper placement of the paper or other material on the base prior to and during cutting; and (iv) a switch located within the housing; and (v) a switch actuator adapted to cooperate with the switch to activate and deactivate the light source, wherein the switch actuator is located in the handle grip and, wherein the light source is activated when the elongated cutting arm is raised and deactivated when the elongated cutting arm is lowered; and (b) material to be cut, wherein the material to be cut further includes paper, posterboard, cardboard, and combinations thereof.

2. The system of claim 1, further comprising a power source for the light source.

3. The system of claim 1, wherein the base further includes a grid formed thereon for facilitating proper alignment of the material to be cut.

4. The system of claim 1, wherein the housing further includes at least one light-emitting aperture formed therein for allowing light from the adjustable light source to exit the housing.

5. The system of claim 1, wherein the adjustable light source further comprises at least one laser.

6. The system of claim 1, wherein the elongated cutting arm further includes manually-releasable locking means for securing the elongated cutting arm against the base when the cutting device is not in use.

7. A paper cutting device, comprising:

(a) a substantially flat base, wherein the base is adapted to receive paper and other flat material for cutting, and wherein the base further includes a front edge, a rear edge, a left side, and a right side;

(b) a manually-operated cutting blade assembly pivotally attached to either the right or left side of the base near the rear edge thereof, wherein the cutting blade assembly further includes an elongated cutting arm having a handle grip formed at one end thereof, and wherein the elongated cutting arm is positioned over a predetermined line of cut on the base;

(c) a sighting device mounted on the front edge of the base and on the same side as the elongated cutting arm, wherein the sighting device further includes:

(i) a housing, the housing further including a removable arcuate front cover, a side cover, and a removable lower cover; and (ii) an adjustable light source mounted within and protected by the housing, wherein the adjustable light source further includes:

a) a top portion having two concave sides, wherein the two concave sides secure the light source therein;

b) a middle portion that receives the top portion, wherein the middle portion further includes a stabilizing peg and plurality of screws and biasing members adapted to allow lateral or horizontal movement of the middle portion and top portion to adjust the light source; and c) a bottom portion adapted to receive the middle portion, wherein the bottom portion is adjustably mounted to housing assembly;

wherein the adjustable light source projects a fixed line of visible light from the front edge of the base toward the rear edge of the base along the predetermined line of cut for facilitating proper placement of the paper or other material on the base prior to and during cutting; and (d) a switch located within the housing; and (e) a switch actuator adapted to cooperate with the switch to activate and deactivate the light source, wherein the switch actuator is located in the handle grip and, wherein the light source is activated when the elongated cutting arm is raised and deactivated when the elongated cutting arm is lowered.

8. The device of claim 7, further comprising a power source for the light source.

9. The device of claim 7, further comprising a timer for deactivating the laser after a predetermined period of time when the cutting arm is raised.

10. The device of claim 7, wherein the base further includes a grid formed thereon for facilitating proper alignment of the material to be cut.

11. The device of claim 7, wherein the housing further includes at least one light-emitting aperture formed therein for allowing light from the adjustable light source to exit the housing.

12. The device of claim 7, wherein the adjustable light source further comprises at least one laser.

13. The device of claim 7, wherein the handle grip further includes manually-releasable locking means for securing the elongated cutting arm to the base when the cutting device is not in use.

14. A paper cutting device, comprising:

(a) a substantially flat base, wherein the base is adapted to receive paper and other flat material for cutting, and wherein the base further includes a front edge, a rear edge, a left side, and a right side;

(b) a manually-operated cutting blade assembly pivotally attached to either the right or left side of the base near the rear edge thereof, wherein the cutting blade assembly further includes an elongated cutting arm having a handle grip formed at one end thereof, and wherein the elongated cutting arm is positioned over a predetermined line of cut on the base;

(c) a sighting device mounted on the front edge of the base on the same side as the elongated cutting arm, wherein the sighting device further includes:

(i) a housing assembly the housing assembly further including a removable arcuate front cover, a side cover, and a removable lower cover; and (ii) an adjustable laser mounted within and protected by the housing assembly; wherein the adjustable laser further includes:

a) a top portion having two concave sides, wherein the two concave sides secure the adjustable laser therein;

b) a middle portion that receives the top portion, wherein the middle portion further includes a stabilizing peg and plurality of screws and biasing members adapted to allow lateral or horizontal movement of the middle portion and top portion to adjust the laser source; and c) a bottom portion adapted to receive the middle portion, wherein the bottom portion is adjustably mounted to housing assembly; and wherein the laser projects a fixed line of visible light from the front edge of the base toward the rear edge of the base along the predetermined line of cut for facilitating proper placement of the paper or other material on the base prior to and during cutting; and (d) a switch located within the housing;

(e) a switch actuator adapted to cooperate with the switch to activate and deactivate the laser, wherein the switch actuator is located in the handle grip and, wherein the laser is activated when the elongated cutting arm is raised and deactivated when the elongated cutting arm is lowered; and (f) a timer mounted in the housing assembly for deactivating the laser after a predetermined period of time when the cutting arm is raised.

15. The device of claim 14, further comprising a power source for the light source.

16. The device of claim 14, wherein the base further includes a grid formed thereon for facilitating proper alignment of the material to be cut.

17. The device of claim 14, wherein the housing further includes at least one light-emitting aperture formed therein for allowing light from the adjustable light source to exit the housing.

18. The device of claim 14, wherein the laser provides a wavelength of between about 630 to about 670 nanometers at about 0.1 to about 5 milliwatts of power.

19. The device of claim 14, wherein the elongated cutting arm further includes manually-releasable locking means for securing the elongated cutting arm to the base when the cutting device is not in use.

* * * * *